US011427972B2

(12) United States Patent
Ries et al.

(10) Patent No.: US 11,427,972 B2
(45) Date of Patent: Aug. 30, 2022

(54) COMPACTOR DRUM EDGE INDICATION DEVICE

(71) Applicant: Caterpillar Paving Products Inc., Brooklyn Park, MN (US)

(72) Inventors: Michael W. Ries, Andover, MN (US); John L. Marsolek, Watertown, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 61 days.

(21) Appl. No.: 16/388,605

(22) Filed: Apr. 18, 2019

(65) Prior Publication Data

US 2020/0332480 A1 Oct. 22, 2020

(51) Int. Cl.

| | |
|---|---|
| ***E01C 19/26*** | (2006.01) |
| ***E01C 19/00*** | (2006.01) |
| ***E01C 23/12*** | (2006.01) |
| ***E01C 23/088*** | (2006.01) |

(52) U.S. Cl.

CPC ..... *E01C 19/004* (2013.01); *E01C 19/26* (2013.01); *E01C 23/088* (2013.01); *E01C 23/127* (2013.01)

(58) Field of Classification Search

None

See application file for complete search history.

(56) References Cited

U.S. PATENT DOCUMENTS

| | | | | |
|---|---|---|---|---|
| 3,909,147 | A * | 9/1975 | Takata | E01C 19/286 404/117 |
| 5,052,854 | A * | 10/1991 | Correa | E01C 23/163 180/169 |
| 5,664,909 | A * | 9/1997 | Lindgren | E01C 19/26 180/326 |
| 6,827,524 | B2 * | 12/2004 | Starry, Jr. | E01C 19/238 404/122 |
| 7,731,450 | B2 * | 6/2010 | Congdon | E01C 19/288 404/84.5 |
| 7,753,620 | B2 * | 7/2010 | Kotting | E01C 23/088 404/94 |
| 8,890,046 | B2 * | 11/2014 | Eul | E01C 19/48 250/205 |
| 9,822,495 | B2 * | 11/2017 | Exline | B05B 12/04 |
| 10,220,770 | B2 * | 3/2019 | Son | B60Q 1/346 |
| 10,386,043 | B1 * | 8/2019 | Lim | F21V 14/04 |
| 10,602,081 | B2 * | 3/2020 | Nakayama | H04N 5/272 |
| 10,676,022 | B2 * | 6/2020 | Zevenbergen | G01C 21/3461 |
| 10,745,867 | B2 * | 8/2020 | Weber | E01C 19/006 |
| 10,752,165 | B2 * | 8/2020 | Omanovic | B60Q 1/22 |

(Continued)

FOREIGN PATENT DOCUMENTS

| | | | |
|---|---|---|---|
| DE | 102014006477 | 11/2015 | |
| EP | 2395150 | 12/2011 | |
| GB | 2568750 A * | 5/2019 | B62D 15/027 |

*Primary Examiner* — Thomas B Will
*Assistant Examiner* — Katherine J Chu
(74) *Attorney, Agent, or Firm* — Schwegman, Lundberg & Woessner

(57) ABSTRACT

A compactor machine includes a machine frame, at least one cylindrical roller drum rotatably coupled to the machine frame and rotatable about a drum axis oriented generally transverse to a direction of travel of the compactor machine, and a first light attached to the machine frame, the light shining a line of light on a surface that indicates a location of an edge of the roller drum.

17 Claims, 4 Drawing Sheets

(56) References Cited

U.S. PATENT DOCUMENTS

| | | | | |
|---|---|---|---|---|
| 2003/0226290 | A1* | 12/2003 | Savard | E02F 9/2037 37/348 |
| 2011/0102196 | A1* | 5/2011 | Kadowaki | B62D 15/0275 340/932.2 |
| 2017/0160094 | A1* | 6/2017 | Zhang | H04N 9/3161 |
| 2019/0166338 | A1* | 5/2019 | Greenwood | B60Q 1/48 |
| 2020/0033146 | A1* | 1/2020 | Cash | A01B 69/008 |
| 2020/0135023 | A1* | 4/2020 | Wang | B60Q 1/346 |
| 2020/0346704 | A1* | 11/2020 | Mochizuki | B62J 27/00 |

* cited by examiner

COMPACTOR DRUM EDGE INDICATION DEVICE

TECHNICAL FIELD

This disclosure relates to road construction equipment, and more specifically to a compactor machine with roller drums for traveling over a surface to be compacted.

BACKGROUND

Compactors are machines used to compact initially loose materials, such as asphalt, soil, gravel, and the like, to a densified and more rigid mass or surface. For example, during construction of roadways, highways, parking lots and the like, loose asphalt is deposited and spread over the surface to be paved. Compactors are also utilized to compact soil or recently laid concrete at construction sites and on landscaping projects to produce a densified, rigid foundation on which other structures may be built. Most compactors include a rotatable roller drum that may be rolled over the surface to compress the material underneath. In addition to utilizing the weight of the roller drum to provide the compressive forces that compact the material, some compactors are configured to also induce a vibratory force to the surface.

However, identifying the path of the leading edge of a compactor drum can be difficult to see for the machine operator. Misreading the trajectory of the drum can cause damage to the jobsite and surface finish of the asphalt mat. German Patent DE102014006477 describes a guide bar that can be mounted to a machine and indicates to the driver any deviation from a given target lane. This allows the operator to drive the machine in a pre-defined lane.

SUMMARY

In an example according to this disclosure, a compactor machine can include a machine frame, at least one cylindrical roller drum rotatably coupled to the machine frame and rotatable about a drum axis oriented generally transverse to a direction of travel of the compactor machine, and a first light attached to the machine frame, the light shining a line of light on a surface that indicates a location of an edge of the roller drum.

In another example, a road construction machine can include a machine frame, a work implement attached to the machine frame, and a first light attached to the machine frame, the light shining a line of light on a surface that indicates a location of an edge of the work implement, and wherein the line of light extends a distance in front of the work implement to indicate a trajectory of the work implement.

In another example according to the present disclosure, a method of compacting a surface can include providing a compactor machine including a machine frame and including a cylindrical roller drum attached to the machine frame and in rolling contact with a surface, the roller drum rotatable about a drum axis oriented generally perpendicular to a direction of travel of the compactor machine, and shining a first light which is attached to the machine frame, the light shining a line of light on the surface that indicates a location of an edge of the roller drum.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
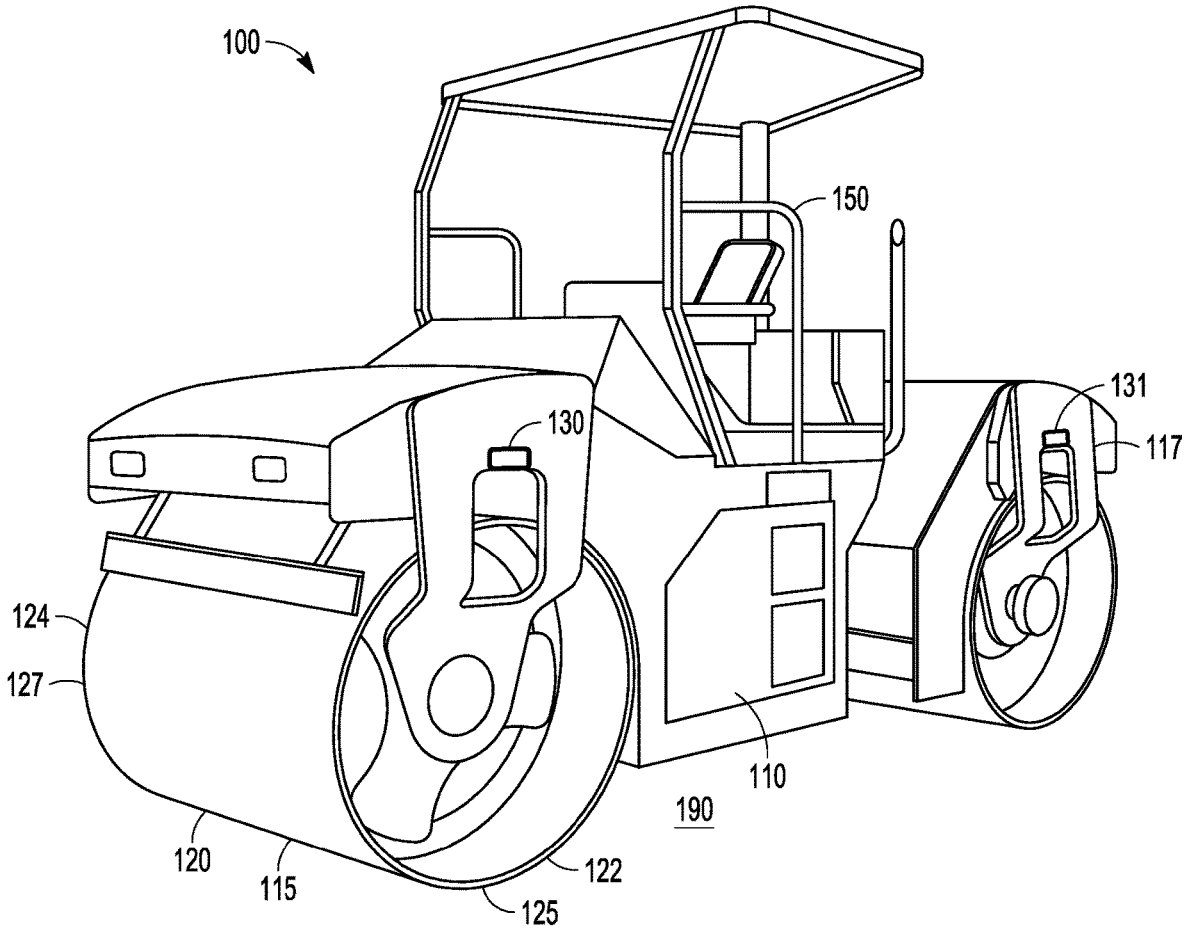
FIG. 1 shows a perspective view of a compactor machine, in accordance with one embodiment.

FIG. 1 shows a perspective view of a compactor machine 100, in accordance with one embodiment. Compactor machine 100 can be of the self-propelled type that can travel over a surface 190 under its own power. The compactor machine 100 generally includes a body or machine frame 110 that connects and associates the various physical and structural features that enable the compactor machine 100 to function. These features can include an operator's cab 150 that is mounted on top of the machine frame 110 from which an operator may control and direct operation of the compactor machine 100. Accordingly, a steering feature and similar controls may be located within the operator's cab 150. To propel the compactor machine 100 over the surface 190, a power system such as an internal combustion engine can also be mounted to the machine frame 110 and can generate power that is converted to physically move the machine.

Compactor machine 100 can include at least a cylindrical roller drum 120 which is rotatable about a drum axis oriented generally transverse to a direction of travel of the compactor machine 100. The cylindrical roller drum 120 includes a first end 122 and an opposite second end 124, with the drum axis extending between the first and second ends 122, 124. In the disclosed embodiment, compactor machine 100 also includes a second cylindrical roller drum 140 coupled to the machine frame 110. The roller drums 120, 140 are attached to the machine frame 110 using respective drum supports 115, 117. Roller drums 120, 140 are in rolling contact with the surface 190. In this example, the compactor machine 100 articulates such that the back section including the second cylindrical drum 140 can articulate relative to the front section including the cylindrical drum 120.

The compactor machine 100 further includes a first light 130 attached to the machine frame 110. As will be detailed below, the first light 130 shines a line of light on the surface 190 that indicates to the operator a location of an edge 125 of the roller drum 120. The light 130 can be attached to the drum support 115 of the machine frame 110. In some examples the light 130 can be an LED light or a laser light, for example.

Figure 2:
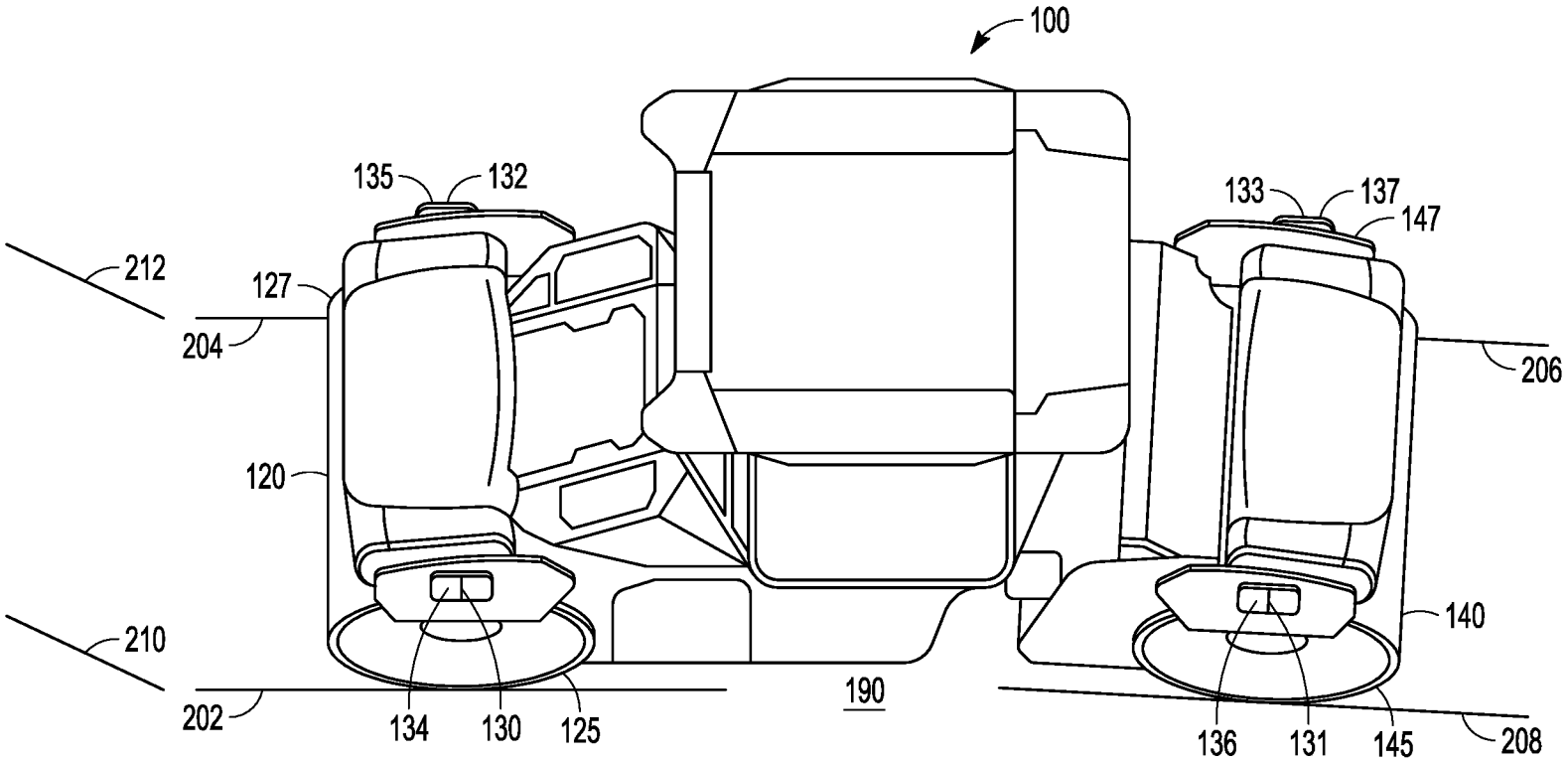
FIG. 2 shows a top view of the compactor machine of FIG. 1, in accordance with one embodiment.

FIG. 2 shows a top perspective view of the compactor machine 100. The compactor machine 100 includes the light 130 shining a line of light 202 on the surface 190 that indicates a location of the edge 125 of the roller drum 120. The line of light 202 can extend a distance in front of the roller drum 120 to indicate a trajectory of the roller drum 120. Thus, the present location of the edge 125 is known by the driver and where the edge 125 is going is also known. Similarly a line of light 204 provides the same features to for an opposite edge 127 of the roller drum 120. This allows the driver to make any appropriate corrections so as to avoid any obstacles on the job. In addition these features provides the ability for the driver to ensure adequate coverage of the working surface with the machine. For example, following a predetermined rolling pattern with a compactor machine 100.

The compactor machine 100 can further include a second light 131, a third light 132, and a fourth light 133 attached to the machine frame 110. The first, second, third, and fourth lights 130-133 each shining a respective line of light 202, 204, 206 208 on the surface that indicates the respective locations of first and second edges 125, 127, 145, 147 of each of the roller drums 120, 140.

Each of the lines of light 202, 204, 206, 208 can extend in front of and behind each edge 125, 127, 145, 147 of each of the roller drums 120, 140. Since the compactor machine 100 articulates the roller drum 120 and the roller drum 140 can have different orientations and have different trajectories. The present system allows a driver to see at a glance where the edges 125, 127, 145, 147 of both rollers drums 120, 140 are located and where the edges are heading. Moreover, extending the lines of light 202-208 both in front of and behind the roller drums 120, 140 facilitates the same use of the lines of lights 202-208 when the compactor machine 100 machine is driven going in the reverse direction (i.e. roller drum 140 becomes the "front" roller and roller drum 120 becomes the "rear" roller drum). Thus, going in either direction, the lines of light 202-208 provide guidance to the operator.

As noted above, identifying the path of the leading edge of a compactor drum can be difficult to see. Misreading the trajectory of the drum can cause damage to the jobsite and surface finish of the asphalt mat. Here, the one or more lights 130-133 can be mounted on the machine in such a way that the compactor drum edge and its trajectory are illuminated. Providing this illumination clearly identifies to the machine operator where the drum edge is presently located and where it will be going as the machine continues its current route. The illumination facilitates an identification of the drum edge and a movement of the drum edge by the machine operator. The present system works whether the machine is moving forward or backward, and the use on an articulating machine allows the operator to see each drum edge independently.

In one embodiment, the machine can include additional lights such as fifth, sixth, seventh, and eighth lights 134, 135, 136, 137 located on the machine frame 110. The lights 134-137 can each shine additional lines of light showing a planned travel path or target trajectory for the edges of the roller drums 120, 140. For example, lights 134 and 135 can shine lines of light 210, 212 on the traveling surface 190 showing where the machine is planned to go so the operator can identify if the machine is off the recommended path. Accordingly, the system can show both a line of light 210, 212 indicative of the planned travel path, along with the lines of light 202, 204 showing current actual trajectory. Each of the lights 134-137 can show the planned travel path by shining lines of light either in front of or behind each of the roller drums 120, 140, depending on the direction of travel of the machine 100.

The idea of providing a light to indicate the location and trajectory of a work implement of a road construction machine can be applied to other machines also.

Figure 3:
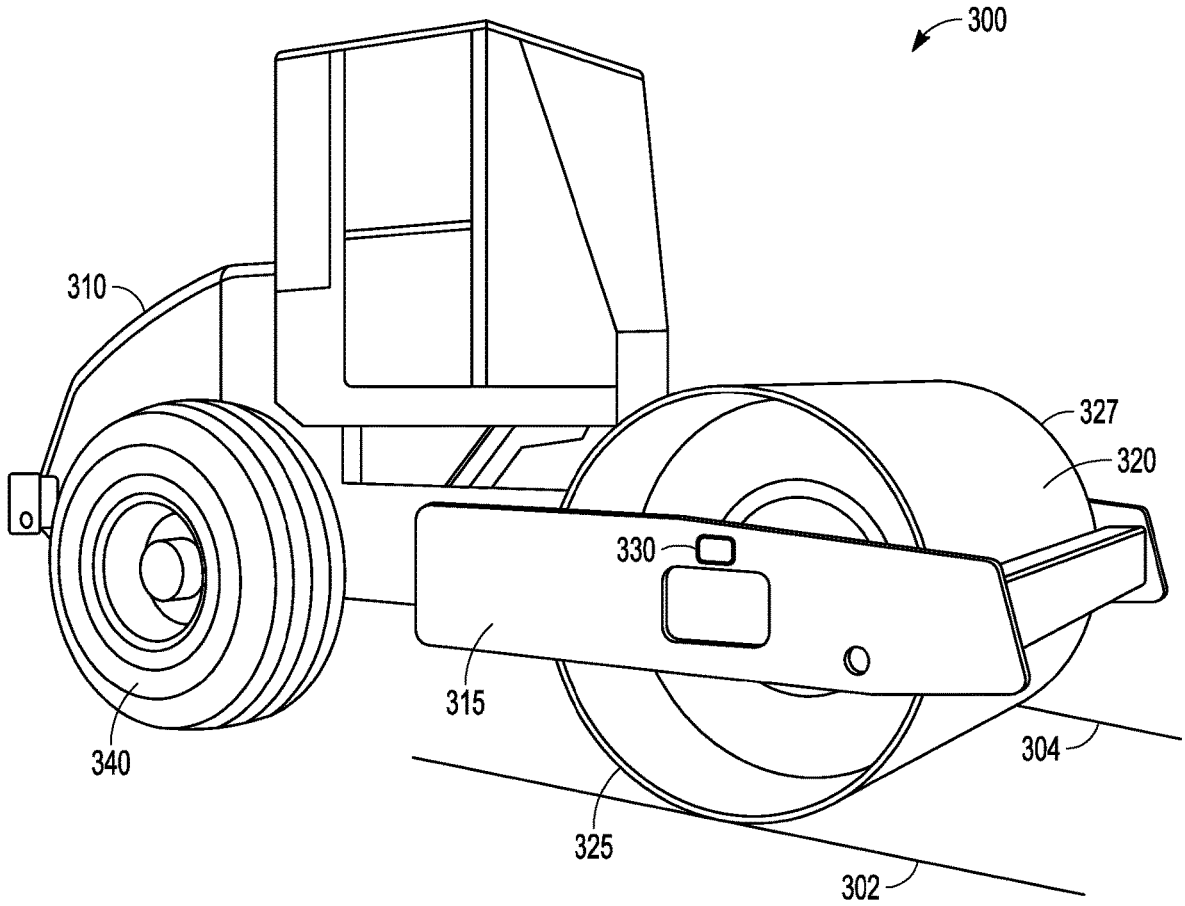
FIG. 3 shows a perspective view of a compactor machine, in accordance with one embodiment.

For example, FIG. 3 shows a perspective view of a compactor machine 300, in accordance with one embodiment. The compactor machine 300 includes a machine frame 310 and a work implement attached to the machine frame 310. In this example, the work implement includes a single cylindrical roller drum 320. Compactor machine 300 also includes rear wheels 340 attached to the machine frame 310 for driving the machine.

The compactor machine 300 can include a first light 330 attached to the machine frame 310 on a drum support 315. The light 330 can shine a line of light 302 on a surface that indicates a location of an edge 325 of the roller drum 320. The line of light 302 can extend a distance in front of the roller drum 320 to indicate a trajectory of the roller drum 320. The compactor machine can also include a second light (not shown) to shine a line of light 304 to indicate a location and trajectory of a second edge 327 of the roller drum 320. As discussed above, the lines of light 302, 304 can extend in front of and behind the roller drum 320.

Figure 4:
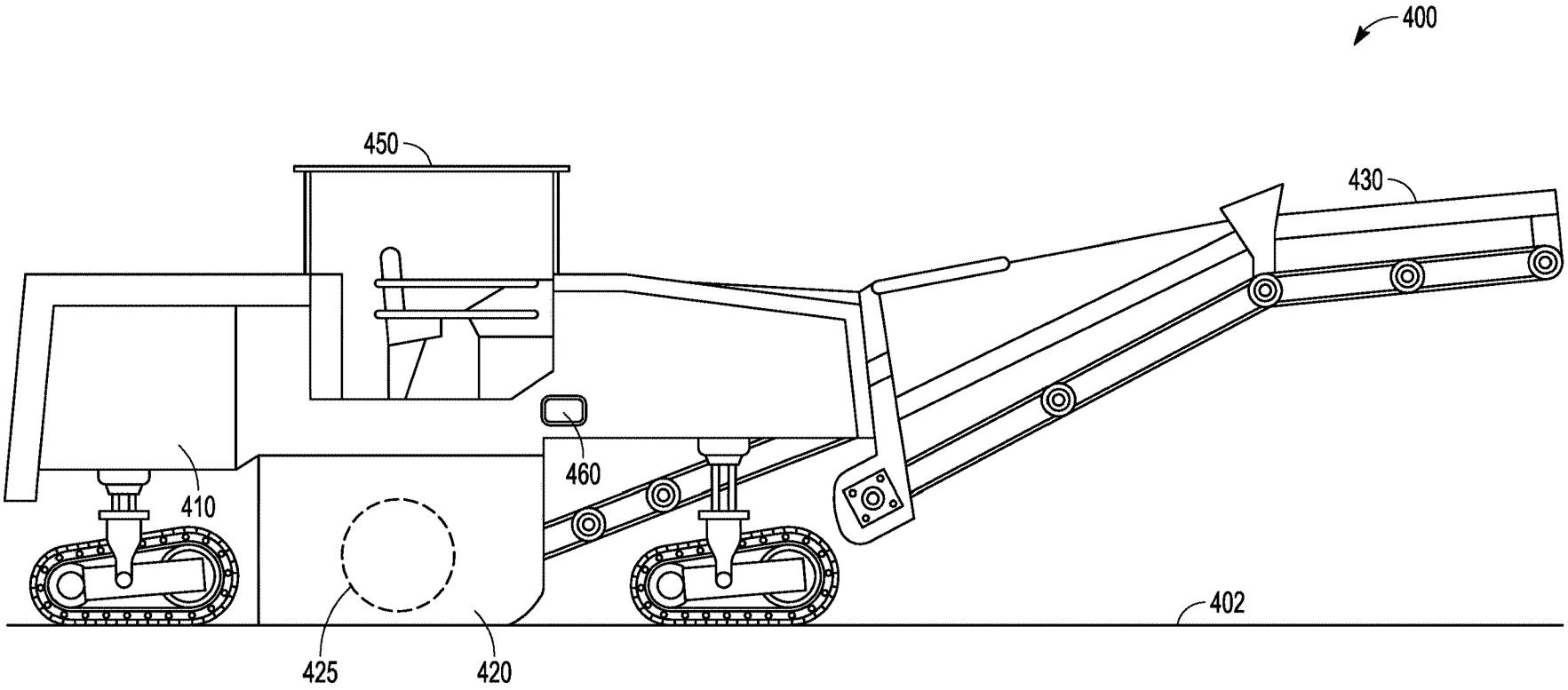
FIG. 4 shows a perspective view of a cold planer, in accordance with one embodiment.

FIG. 4 shows a perspective view of a cold planer 400, in accordance with one embodiment. The cold planer 400 generally includes a machine frame 410, an operator station 450, and a conveyor 430. A milling assembly 420 is attached to the machine frame 410, with a work implement such as a grinding drum 425 located therein.

Here, a first light 460 can be attached to the machine frame 410. The light 460 shines a line of light 402 on a surface that indicates a location of an edge of the grinding drum 425. Also, the line of light 402 can extend a distance in front of the grinding drum 425 to indicate a trajectory of the grinding drum 425. In one example, a second light can be provided on the other side of the cold planer 400 to indicate the location of the other edge of the grinding wheel 425. In one example, the lights can be positioned to show an edge of the outer walls of the milling assembly 420.

In another example, the present system can be used on a rotary mixer machine. Rotary mixers include grinding drums similar to the cold planar discussed above and lights can be affixed to the rotary mixer in a manner which would show a line of light projection of the edges of the grinding drum or of the walls of the mixing chamber similar as described above with the grinding drum and milling assembly on the cold planer.

INDUSTRIAL APPLICABILITY

The present system is applicable during many situations in road construction. Again, it is useful for the machine operator to know the location and trajectory of the edges of the present work implement being used.

For example, and referring to the compactor machine of FIGS. 1-2, a method of compacting a surface, such as an asphalt surface, can include providing a compactor machine 100 including a machine frame 110 and a cylindrical roller drum 120 in rolling contact with the surface, and shining a first light 130 which is attached to the machine frame 110. The light 130 shines a line of light 202 on a surface that indicates a location of an edge 125 of the roller drum 120.

In further example, the line of light 202 can extend a distance in front of the roller drum to indicate a trajectory of the roller drum 120.

In another example, the compactor machine 100 can further include a second cylindrical roller drum 140 rotatably coupled to the machine frame 110 and rotatable about a drum axis oriented generally transverse to a direction of travel of the compactor machine 110, and further including second, third, and fourth lights 131, 132, 133 attached to the machine frame 110. The first, second, third, and fourth lights 130-133 each can shine a line of light 202, 204, 206, 208 on the surface that indicates the respective location of the first and second edges 125, 127, 145, 147 of each of the first and second roller drums 120, 140. Moreover, each of the lines of light 202, 204, 206, 208 can extend in front of and behind each of the roller drums 120, 140.

Moreover, as, discussed above, the method can include providing additional lights 134, 135, 136, 137 located on the machine frame 110. The lights 134-137 can each shine additional lines of light 210, 212 showing a planned travel path for the edges of the roller drums 120, 140.

Various examples are illustrated in the figures and foregoing description. One or more features from one or more of these examples may be combined to form other examples.

The above detailed description is intended to be illustrative, and not restrictive. The scope of the disclosure should, therefore, be determined with references to the appended claims, along with the full scope of equivalents to which such claims are entitled.

What is claimed is:

1. A compactor machine comprising:

a machine frame;

at least one cylindrical roller drum rotatably coupled to the machine frame and rotatable about a drum axis oriented generally transverse to a direction of travel of the compactor machine;

a first light attached to the machine frame, the first light shining a first line of light on a surface that indicates a present location and present trajectory of a first edge of the roller drum;

a second light attached to the machine frame, the second light shining a second line of light on the surface that indicates a planned, target trajectory for the first edge of the roller drum of the compactor machine such that the second line of light is used as a reference so an operator is able to steer the compactor machine to align the first line of light to the second line of light;

a third light attached to the machine frame, the third light shining a third line of light on the surface that indicates a present location and present trajectory of a second edge of the roller drum; and a fourth light attached to the machine frame, the fourth light shining a fourth line of light on the surface that indicates a planned, target trajectory for the second edge of the roller drum of the compactor machine such that the fourth line of light is used as a reference so an operator is able to steer the compactor machine to align the third line of light to the fourth line of light.

2. The compactor machine of claim 1, wherein the first line of light extends a distance in front of the roller drum to indicate the present trajectory of the roller drum.

3. The compactor machine of claim 1, wherein the cylindrical roller drum includes a first end and an opposite second end, the drum axis extending between the first and second ends.

4. The compactor machine of claim 1, further including a second cylindrical roller drum rotatably coupled to the machine frame and rotatable about a drum axis oriented generally transverse to a direction of travel of the compactor machine.

5. The compactor machine of claim 4, further including fifth and sixth lights attached to the machine frame, the fifth and sixth lights each shining a line of light on the surface that indicates the respective locations of a first edge and a second edge of the second cylindrical roller drum.

6. The compactor machine of claim 5, wherein each of the lines of light extends in front of and behind each edge of each of the roller drums.

7. The compactor machine of claim 1, wherein the first light is an LED.

8. The compactor machine of claim 1, wherein the first light is a laser.

9. A road construction machine comprising:

a machine frame;

a work implement attached to the machine frame;

a first light attached to the machine frame, the first light shining a first line of light on a surface that indicates a present location of a first edge of the work implement, and wherein the first line of light extends a distance in front of the work implement to indicate a present trajectory of the first edge of the work implement;

a second light attached to the machine frame, the second light shining a second line of light on the surface that indicates a target trajectory for the first edge of the work implement of the road construction machine such that the second line of light is used as a reference so an operator is able to steer the road construction machine to align the first line of light to the second line of light;

a third light attached to the machine frame, the third light shining a third line of light on the surface that indicates a present location of a second edge of the work implement, and wherein the third line of light extends a distance in front of the second edge work implement to indicate a present trajectory of the second edge of the work implement; and a fourth light attached to the machine frame, the fourth light shining a fourth line of light on the surface that indicates a planned, target trajectory for the second edge of the work implement of the road construction machine such that the fourth line of light is used as a reference so an operator is able to steer the road construction machine to align the third line of light to the fourth line of light.

10. The road construction machine of claim 9, wherein the road construction machine includes a cold planer, and wherein the work implement includes a grinding drum, wherein the line of light indicates a location of an edge of the grinding drum.

11. The road construction machine of claim 9, wherein the road construction machine includes a compactor machine and the work implement includes a cylindrical roller drum.

12. The road construction machine of claim 11, wherein the compactor machine includes the cylindrical roller drum and includes wheels attached to the machine frame.

13. The road construction machine of claim 11, further including a second cylindrical roller drum rotatably coupled to the machine frame and rotatable about a drum axis oriented generally transverse to a direction of travel of the compactor machine.

14. The road construction machine of claim 13, further including fifth and sixth lights attached to the machine frame, the fifth and sixth lights each shining a line of light on the surface that indicates the respective locations of first and second edges of each of the second cylindrical roller drum.

15. The road construction machine of claim 14, wherein each of the lines of light extends in front of and behind each of the roller drums.

16. A method of compacting a surface, the method comprising:

providing a compactor machine including a machine frame and including a first cylindrical roller drum attached to the machine frame and in rolling contact with a surface, the first roller drum rotatable about a drum axis oriented generally perpendicular to a direction of travel of the compactor machine;

shining a first light which is attached to the machine frame, the first light shining a first line of light on the surface that indicates a present location of a first edge of the roller drum, wherein the first line of light extends a distance in front of the roller drum to indicate a present trajectory of the first edge of the roller drum;

shining a second light which is attached to the machine frame, the second light shining a second line of light on the surface that indicates a planned, target trajectory for the first edge of the roller drum of the compactor machine such that the second line of light is used as a reference so an operator is able to steer the roller drum of the compactor machine to align the first line of light to the second line of light;

shining a third light which is attached to the machine frame, the third light shining a third line of light on the surface that indicates a present location of a second edge of the roller drum, wherein the third line of light extends a distance in front of the second edge of the roller drum to indicate a present trajectory of the second edge of the roller drum; and shining a fourth light which is attached to the machine frame, the fourth light shining a fourth line of light on the surface that indicates a planned, target trajectory for second edge of the roller drum of the compactor machine such that the fourth line of light is used as a reference so an operator is able to steer the roller drum of the compactor machine to align the third line of light to the fourth line of light.

17. The compactor machine of claim 16, further including a second cylindrical roller drum rotatably coupled to the machine frame and rotatable about a drum axis oriented generally transverse to a direction of travel of the compactor machine, and further including second, third, and fourth lights attached to the machine frame, the first, second, third, and fourth lights each shining a line of light on the surface that indicates the respective location of the first and second edges of each of the first and second roller drums, wherein each of the lines of light extends in front of and behind each of the roller drums.

* * * * *